US009073605B2

(12) United States Patent
Hall

(10) Patent No.: US 9,073,605 B2
(45) Date of Patent: Jul. 7, 2015

(54) BOAT WITH ACTIVE SUSPENSION SYSTEM

(71) Applicant: Velodyne Acoustics, Inc., Morgan Hill, CA (US)

(72) Inventor: David S. Hall, San Jose, CA (US)

(73) Assignee: Velodyne Acoustics, Inc., Morgan Hill, CA (US)

( * ) Notice: Subject to any disclaimer, the term of this patent is extended or adjusted under 35 U.S.C. 154(b) by 68 days.

(21) Appl. No.: 13/773,265

(22) Filed: Feb. 21, 2013

(65) Prior Publication Data

US 2013/0213288 A1 Aug. 22, 2013

Related U.S. Application Data

(60) Provisional application No. 61/601,690, filed on Feb. 22, 2012, provisional application No. 61/692,473, filed on Aug. 23, 2012.

(51) Int. Cl.

| | |
|---|---|
| ***B63B 39/00*** | (2006.01) |
| ***B63B 1/00*** | (2006.01) |
| ***B63B 17/00*** | (2006.01) |
| ***B63B 1/14*** | (2006.01) |
| *B63B 3/48* | (2006.01) |

(52) U.S. Cl.

CPC ..... *B63B 17/0081* (2013.01); *B63B 1/14* (2013.01); *B63B 17/00* (2013.01); *B63B 2001/145* (2013.01); *B63B 2003/485* (2013.01); *B63B 2017/0072* (2013.01)

(58) Field of Classification Search

CPC ..... B63B 1/14; B63B 39/00; B63B 39/05; B63B 1/322; B60G 17/08; B60G 17/0155; B60G 2500/10

USPC ..... 114/61.15, 61.16, 85, 279, 283, 122

See application file for complete search history.

(56) References Cited

U.S. PATENT DOCUMENTS

| | | | | |
|---|---|---|---|---|
| 2,347,959 | A | 5/1944 | Moore et al. | |
| 3,427,038 | A * | 2/1969 | Gauss et al. | 114/363 |
| 4,457,248 | A | 7/1984 | Thurston | |
| 4,468,050 | A | 8/1984 | Woods et al. | |
| 5,237,947 | A | 8/1993 | Manning | |
| 5,408,948 | A | 4/1995 | Arii et al. | |
| 6,176,190 | B1 | 1/2001 | Ozga | |
| 6,763,774 | B1 | 7/2004 | Ranieri et al. | |
| 7,743,720 | B1 | 6/2010 | Salani | |
| 8,220,404 | B2 | 7/2012 | Grenestedt | |
| 2004/0024503 | A1 | 2/2004 | Swinbanks et al. | |
| 2007/0261625 | A1 | 11/2007 | Hodge | |

FOREIGN PATENT DOCUMENTS

WO WO 2011143692 A1 * 11/2011

OTHER PUBLICATIONS

Gatsby, "gyroscopic anti-roll system ("active suspension") for medium sized boats and yachts" http://www.myidea.net/ideas/node/523, p. 1, Sep. 9, 2007.

A.P. Moller—Maersk Group, "Bermuda Challenge" http://www.maersklinelimited.com/bermudachallenge.php, pp. 1-2, May 22, 2013.

* cited by examiner

*Primary Examiner* — S. Joseph Morano
*Assistant Examiner* — Anthony Wiest
(74) *Attorney, Agent, or Firm* — Lowe Graham Jones PLLC

(57) ABSTRACT

A boat having a deck and a hull includes a suspension for suspending the deck with respect to the hull. Sensors are employed to determine motion of the deck, with a controller adjusting the suspension such that it maintains the pose of the deck with respect to an inertial reference and with respect to pitch, roll, and heave of the deck.

10 Claims, 6 Drawing Sheets

BOAT WITH ACTIVE SUSPENSION SYSTEM

PRIORITY CLAIM

This application claims the benefit of U.S. provisional application Ser. No. 61/601,690 filed Feb. 22, 2012, and U.S. provisional application Ser. No. 61/692,473 filed Aug. 23, 2012. The contents of each of the foregoing applications are hereby incorporated by reference.

FIELD OF THE INVENTION

This application relates to boats having active suspension, particularly including boats capable of maintaining a boat deck in a constant heave position.

BACKGROUND OF THE INVENTION

The waves inherently present in lakes, rivers, and oceans produce an unstable platform for boats travelling on such waterways. For many people, the rocking, lifting, and falling motion is unsettling and causes sea sickness. In some cases the motion is merely unpleasant, and for some it is sufficiently severe that sea travel is not possible.

Over the years, a variety of approaches have been pursued to incorporate some form of suspension into a boat, but with limited success. The suspension efforts have mainly been directed to forms of passive dampening of the pitch and roll experienced on the boat, with some systems being as simple as a seat on springs and other systems seeking to cushion the deck of the entire boat through the use of flexible arms, springs and shock absorbers.

One early approach is described in U.S. Pat. No. 2,347,959 for a "water spider." This patent describes the use of four outrigger pontoons connected by a series of linkages to a vessel that is preferably in the form of a fuselage raised above the water. Spring-based shock absorbers are positioned in one or more of the linkages. In general, the objective of the '959 patent is to improve lateral stability while urging the fuselage in a generally horizontal position. This suspended fuselage configuration provided at least some measure of stability in the pitch and roll axes, but offered little in maintaining deck height.

Others have subsequently produced similar boats with suspension systems seeking to dampen pitch and roll in the platform of a boat. A further example is in U.S. Pat. No. 6,176,190 for a "suspension system for a speed boat." In this patent, left, right, and vertical shock assemblies are positioned between the hull and the deck in an effort to dampen movement between the deck and the hull. As a general principle, the deck of the boat will rise and fall with the hull, with the dampening principally affecting pitch, roll, and yaw of the deck with respect to the hull.

A similar approach is described in U.S. Pat. No. 6,763,774 for an "active deck suspension system." As with the above examples, this patent is concerned with shock absorption in the same manner as with the other prior art approaches, but incorporates pneumatic cylinders for damping forces imparted on the boat, using what it characterizes as active control of the suspension.

A common defect among prior art suspension systems incorporated into watercraft is that they generally do not account for all degrees of motion. Most are concerned only with pitch and roll, and none are truly able to maintain a constant deck height, or heave. While some systems can dampen an upward or downwardly directed force to some extent, the systems are only concerned with reducing the effect of the motion and none are directed toward maintaining a constant deck height. Moreover, prior art dampening systems that incorporate a vertical dampening vector tend to raise one region of a boat deck relative to another region. For example, in controlling roll one side of a deck is raised while the other side is fixed or lowered. There is generally no meaningful ability to maintain deck height by incorporating a significant amount of travel of the deck height with respect to the hull or pontoon position of the boat.

Some prior art suspension systems incorporated into boats employ fins that are controlled by gyroscopes to reduce the roll motion, and some of these are effective even when the boat is not moving. In some instances giant mechanical gyroscopes are mounted in a yoke to reduce the rolling motion of the boat. Boat hull design has also matured over the years to provide a degree of "sea keeping," a term describing the levelness of the boat when under way.

But sea sickness remains a common complaint of the casual sailor, feared by so many individuals that it affects the popularity of many common boating outings, from whale watching to ferry service. And there is the less annoying, but still concerning, "sea legs" phenomenon where one feels like one is still rocking on the boat when back on solid ground. These ailments are a function of motion of the deck of the boat in any direction, including the heave direction as well as pitch, roll, and yaw. The prior art systems have managed to dampen some of these forces in certain sea conditions, but have not been particularly effective and have not addressed the control of the deck in the heave direction.

SUMMARY OF THE INVENTION

The preferred version of the invention seek to provide a boat suspension that will isolate the occupants of the vessel from the motions of the sea, both underway and when either at anchor or docked. This is done by separating the boat into two or more segments, such as an "occupied platform" and a "hull" section. In one example, the hull consists of a pair of pontoons, and the platform, a deck structure with provisions for human occupation.

In one example of the invention, the boat deck is not directly fixed to the hull, but rather is suspended by one or more active suspension systems. The hull may be a monohull, a catamaran, a number of outboard pontoons, or any other configuration. In a preferred configuration, the deck is suspended above a plurality of pontoons, with active suspension between the pontoons and the deck.

Some versions of this invention seek to reduce the power consumed by the suspension system to a minimal amount, so that the device can be operated by batteries alone for an extended period of time.

Preferred examples of the invention also provide a suspension system that is free from any audible noise, therefore remaining unobtrusive to the occupants of the vessel.

BRIEF DESCRIPTION OF THE DRAWINGS

Preferred and alternative examples of the present invention are described in detail below with reference to the following drawings.

DETAILED DESCRIPTION OF THE PREFERRED EMBODIMENT

Figure 1:
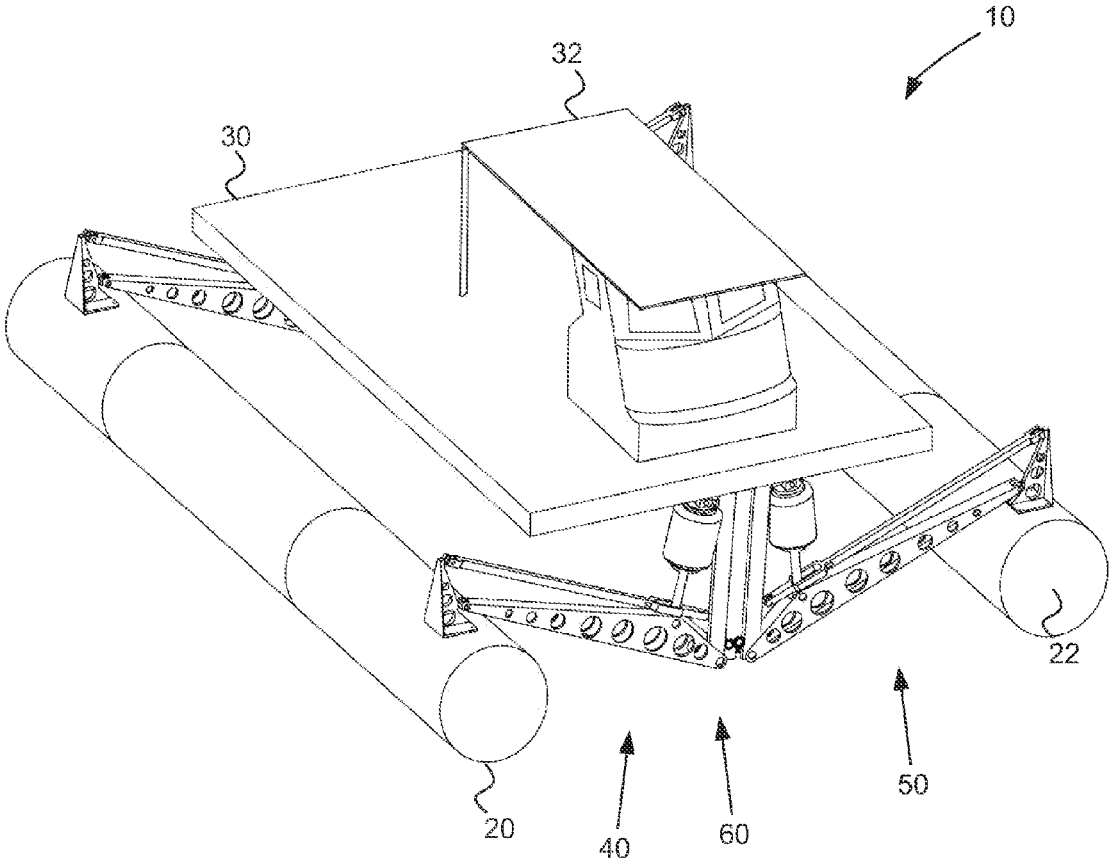
FIG. 1 is a perspective view of a preferred embodiment of a boat with active suspension.

FIG. 1 illustrates a perspective view of a preferred example of a boat 10 with active suspension. In this case, the boat is formed with a hull configured as a pair of pontoons 20, 22. A boat deck 30 supports a cabin 32 that houses the various controls for the boat. The deck is supported by a frame 60 for structural rigidity and further to provide locations for mounting the active suspension. The frame is joined to the pontoons by active suspension and linkage systems, for example 40, 50, and in FIG. 1 only the front suspensions are visible.

Figure 2:
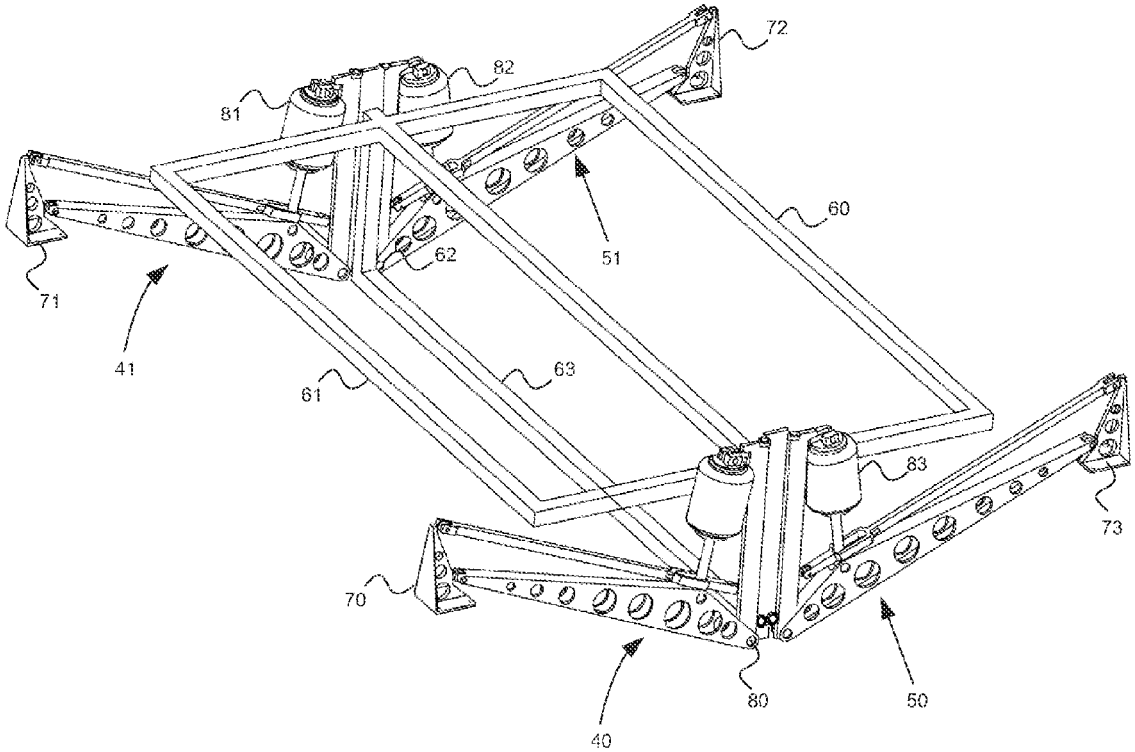
FIG. 2 is a perspective view of the boat of FIG. 1, shown with the deck and cabin removed.

FIG. 2 shows the same preferred example of a boat as illustrated in FIG. 1, but with the cabin and deck floor removed in order to better illustrate the frame and active suspension. Likewise, the pontoons of FIG. 1 are removed for the same purpose. The frame 60 includes an upper frame portion 61, which in this case is configured generally in the shape of a rectangle forming a horizontal plane. In one version the deck of the boat is mounted directly to the upper frame portion 61, while in other versions, particularly for larger or more complicated boat structures, there may be additional decks or various deck levels supported by the upper frame portion 61.

As illustrated, the frame 60 further includes a first vertical post 62 and an opposing second vertical post 64. In this case, each of the first and second vertical posts extend downward from the upper deck portion, with one of the posts being in a forward position and the other of the posts being in an aft position. A lower rail 63 joins the lower portions of the first and second posts together. It should be appreciated that different frame configurations are possible, consistent with the invention. In the preferred configuration the active suspension employs linkages between the frame and pontoons, with the suspension extending vertically between the linkage and a portion of the frame. In other versions, the frame is arranged differently while allowing for an active suspension to be positioned to allow for vertical travel of the deck with respect to the hull.

In the version of FIGS. 1 and 2, the frame 60 is joined to the pontoons by linkages and active suspension systems. On a first side of the boat, a pair of linkages 40, 41 are provided, one at the fore and one at the aft position. Each of linkages is secured to a mount 70, 71 attached to a first pontoon (not shown in FIG. 2). The second side of the boat is configured in the same fashion, with a pair of linkages 50, 51 secured to a pair of mounts 73, 72 attached to a second pontoon (not shown in FIG. 2). An active suspension system 80, 81, 82, 83 is positioned between the linkages and the deck, and in the preferred version the suspension is mounted between the linkages and the frame.

In the illustrated version, the boat is configured with a pair of port and starboard pontoons such that the deck is suspended by a pair of port linkages and suspensions and a pair of starboard linkages and suspensions. It should be appreciated that a larger or smaller number of linkages or suspension systems may be used, consistent with the present invention.

Figure 3:
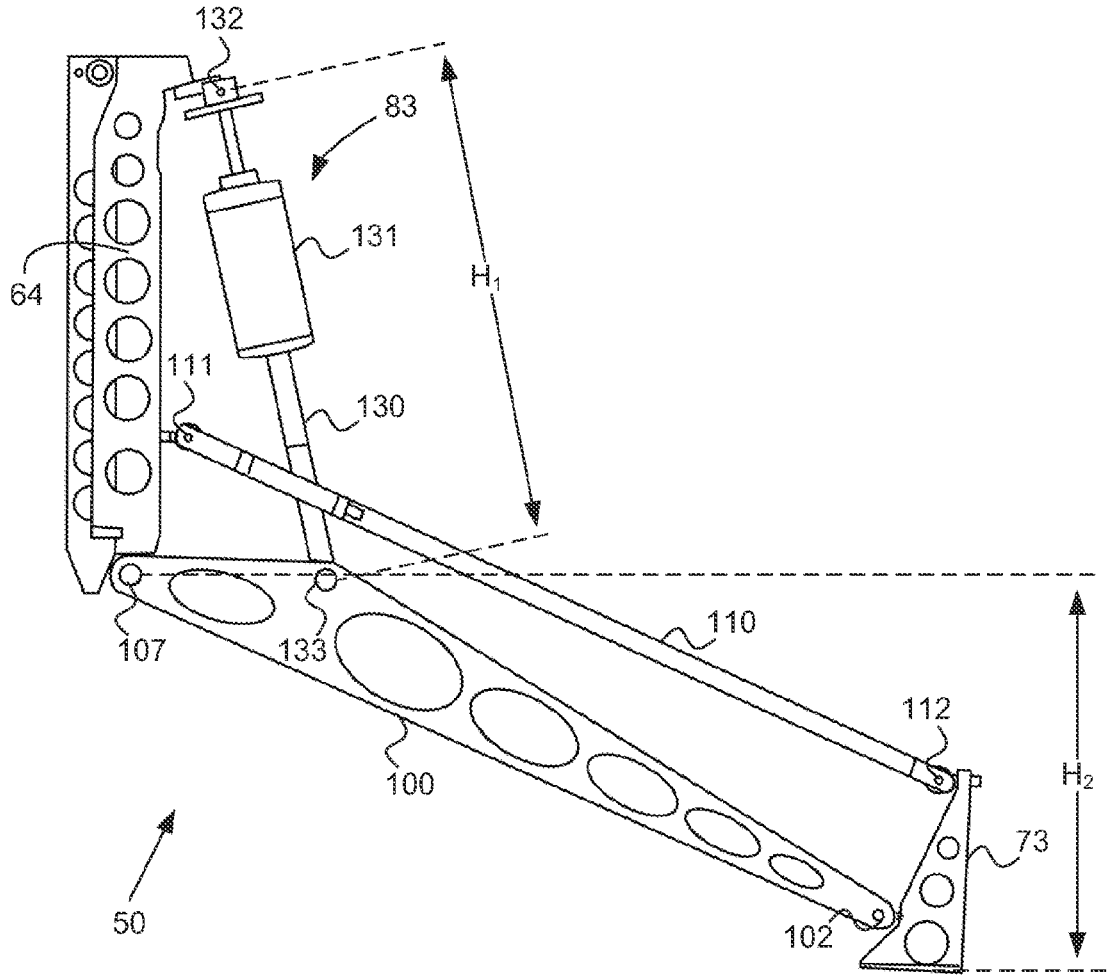
FIG. 3 is a front plan view of a preferred active suspension and linkage, shown in a fully extended position.
Figure 4:
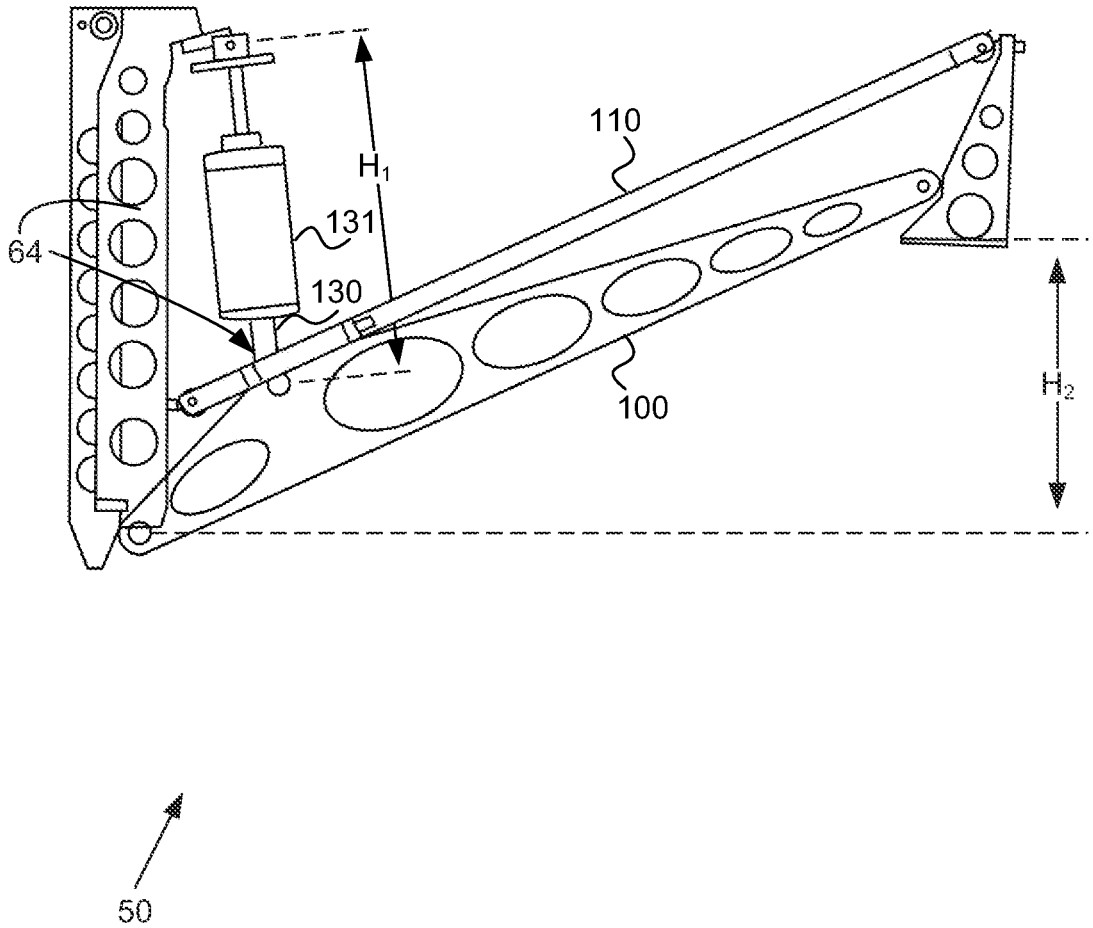
FIG. 4 is a front plan view of the active suspension and linkage of FIG. 3, shown in a fully retracted position.

FIGS. 3 and 4 show a front plan view of one of the sets of linkages 50 and suspension systems 83 in accordance with the preferred version of the invention. Most preferably each of the other linkages and suspensions systems is configure in the same way as illustrated in FIGS. 3 and 4. In FIG. 3 the suspension is shown in an extended position (such that the deck will be at a highest position above the water surface) while in FIG. 4 it is shown in a retracted position (such that the deck will be in a lowest position with respect to the water surface).

The preferred linkage system is essentially configured as a four-bar mechanical linkage employing the vertical frame member 64, the pontoon mount 73, an upper linkage 110 and a lower linkage 100. The lower linkage is pivotally attached at a first end 101 to the vertical frame member and pivotally attached at an opposite second end 102 to the pontoon mount 73. The upper linkage 110 is similarly pivotally attached at a first end 111 to the vertical frame member 64 and at an opposite second end 112 to the pontoon mount 73. The upper linkage is pivotally attached at locations above the lower linkage, thereby forming a planar quadrilateral linkage to join the pontoon to the frame. Each of the other boat linkages 40, 41, 51 are preferably formed in the same fashion.

An active suspension system 83 is positioned between the frame and the linkage, and in the illustrated version the active suspension system includes an upper end 132 pivotally mounted to an upper portion of the vertical frame member 64 and a lower end 133 pivotally mounted to an intermediate location along the lower linkage 100. In the illustrated version, the lower end 133 of the active suspension is attached to the lower linkage 100 at a position about ¼ of the distance from the first end 101 of the lower linkage to the second end 102 of the lower linkage.

The suspension system 83 is operable to isolate the deck from uneven movement of the pontoons through a large range of travel. In general terms, the preferred suspension system includes a central housing with an upper pivot mount and a lower end having a shaft arranged for axial movement into and out of the housing. The axial movement of the shaft (or other arrangements, as discussed below) urge the linkages toward or away from the deck, as desired. With reference to FIG. 3, the suspension system and shaft 130 are in an extended position, thereby pivoting the linkages angularly downward and away from the deck. In FIG. 4, the shaft has retracted into the housing and the linkages are pivoted upward and toward the deck.

Figure 5:
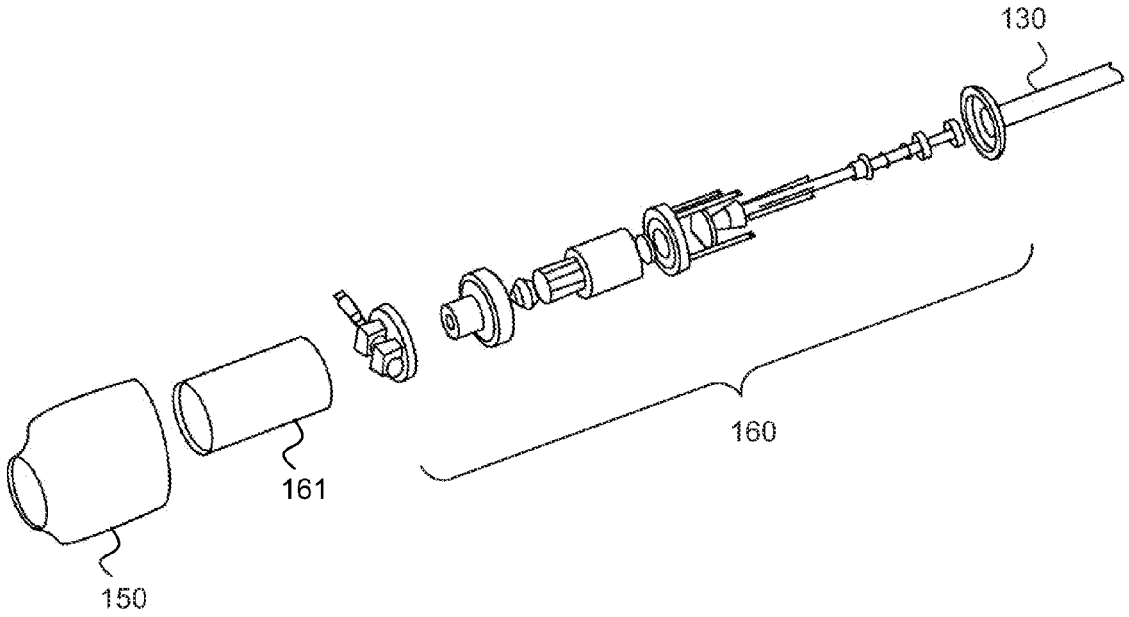
FIG. 5 is an exploded view of a preferred active suspension.

FIG. 5 provides an exploded view of a preferred suspension system. As illustrated, the system includes an air spring 150 and a servo motor 160 mounted in a housing 161. The movable suspension piston 130 is operably connected to the servo motor such that operation of the motor causes the piston to extend out of or retract into the housing. In the illustrated version, the servo employs a threaded rod such that rotation of the rod by the motor causes the piston 130 to move inward or outward with respect to the rod.

In one preferred version, a commercial off the shelf air spring is employed, such as in common use in truck and bus suspensions. In those cases, the air pressure in the spring is slowly adjusted to compensate for varying loads. However, these types of air springs are employed in aftermarket automotive applications, and sometimes the ride height is varied greatly and rapidly. But in all vehicle cases, the travel is much less than necessary for a marine application. For this application, it is preferable to either use several of these springs in series, or use a lever arrangement to multiply the travel to a more appropriate amount. Also, as is the case with most simple springs, there is a spring rate associated, which means that the spring pushes back harder the more it is compressed. This is necessary in an automobile application, but undesirable in the marine application, where a very low spring rate is desired. While this can be accomplished by using a very large air reservoir connected to each spring, such a tank is heavy and takes up a lot of space. However, since a linkage is being employed, the linkage can be arranged so as to partially linearize the spring, so that when the spring is fully compressed, and the pressure in the spring is the highest (as shown in FIG. 4), the lever arm provides the least amount of force transference to the hull structure. Also, the diameter of the piston portion of the air spring can be tapered. Spring pistons are often tapered but for a different purpose, mostly to increase the pressure rapidly at the extreme of travel to provide a softer landing in the event of maximum travel. But in this case, the taper is reversed so that the spring is softer at the extreme of travel to compensate for the pressure increase. Even more advanced, the taper of the piston could be designed to exactly cancel out the variations is force, taking both the air pressure and linkage geometry is consideration.

In an alternate version, as illustrated in FIGS. 1-5, the air bag is formed to wholly or at least partially house a motor configured to drive a shaft for controlling additional vertical movement of the pontoons with respect to the platform. As illustrated, in one configuration a pair of outboard pontoons is pivotally coupled to a boat frame by a plurality of linkages. The boat platform is carried by the frame, with the linkages allowing for a range of vertical motions of the pontoons relative to the platform in order to dampen the motion of the waves and, ideally, isolate the platform from such motion.

An air spring assembly as described and illustrated is mounted at one end to a portion of a linkage and at an opposite end to a portion of the frame or to the platform. The air spring may be in the form of the air bag and belt-driven motor, or may be in the form of the air bag and motor-driven shaft version in accordance with a second embodiment. In the second embodiment, the air bag is configured to house a volume of pressurized air, preferably at an upper position on the spring. A motor is mounted in an intermediate position and is configured to drive a shaft having a distal end extending toward the lower portion of the spring. Most preferably, the motor is also encapsulated within the spring to isolate it from the environment, though in some versions the motor may be positioned outside the air bag.

In one version, the motor is a positioned to produce a rotary motion about a central axis, with the shaft or piston aligned along the central axis so that the motor drives the shaft. One or more threaded attachments are attached to the motor or the shaft to cause vertical movement of a component in engagement with the shaft. Accordingly, rotary movement of the motor produces vertical movement along the shaft. As the spring (and therefore the air bag and shaft) are coupled to the frame at one end and the linkage or pontoon at the opposite end, movement by the motor causes vertical movement of the frame with respect to the pontoon. The preferred motor is configured to drive the shaft in either direction, thereby allowing for upward or downward movement.

While a standard servo motor can be employed in this invention, it is preferred that the motor be operated as a torque device, and that means operating the motor in current mode. This means regulating the current, and allowing to motor to turn freely at any speed, providing that the motor delivers the torque that the controller commands it to. Most motors are used in position mode, and while operable in torque mode, standard controllers can introduce a delay that interferes in the operation of the servo loop. Therefore, the optimum drive for these motors is to run them in a current controlled hysteresis oscillator. This type of oscillator is free running, in that the current is constantly monitored, and when above the desired amount by the hysteresis amount, the controller switches phase and allows the current to drop by the hysteresis amount below the set point. Thus the current is controlled regardless of the supply voltage or back emf of the motor.

Figure 6:
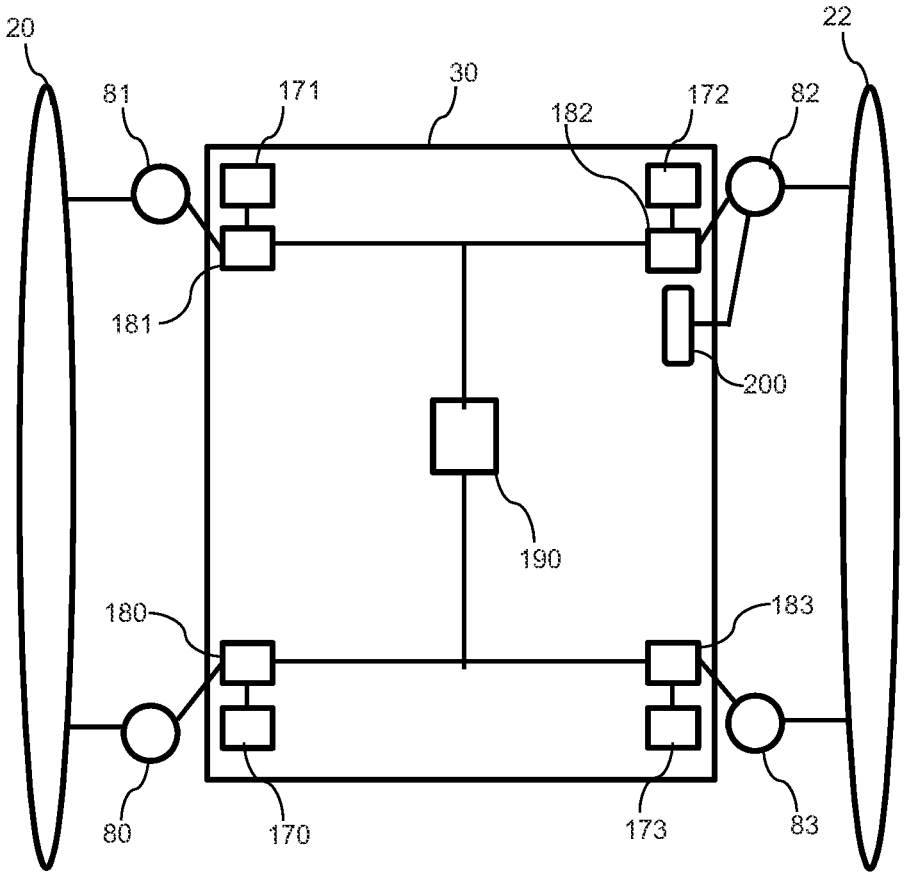
FIG. 6 is a block diagram of a preferred boat and deck having an active suspension system.

FIG. 6 is a block diagram for a boat deck having an active suspension system, notionally presented as a top plan view. It should be understood that any or all of the components shown as being mounted to the deck in FIG. 6 may be positioned above or below the deck, and certain of the components may alternatively be carried on the frame or on the pontoons.

In one version, the control input to the servo system controller is provided by an off-the-shelf IMU (inertial measurement unit). In general, the IMU 190 is mounted close to the center of the deck 30 or platform portion of the boat. This implementation is less than ideal, however, because the platform is typically a rather flexible structure, with a fair amount of mass associated with it, and any movement of a corner has a certain amount of time delay (and resonance) associated with it so that there is a time lag between when the motor moves the suspension and when the IMU records that motion. This type of problem is known to limit the amount of feedback that can be achieved before the system begins to oscillate.

The solution to this problem is to employ multiple accelerometers, one located close to each actuator, so that the time delay between the motor motion and the accelerometer is minimized. As shown in FIG. 6, four accelerometers 170, 171, 172, 173 are provided and positioned in the corners of the deck 30. In essence, each quadrant of the platform is individually stabilized in the "Z" or up-down direction, and the centrally located IMU 190 provides correction for pitch and roll, but at a lower gain. Some refer to this type of combination as a Kalman filter. Thus high gains can be employed with oscillation, and the stability of the entire structure is optimized.

With further reference to FIG. 6, the IMU 190 provides a signal representative of inertial motion such as pitch, roll, and yaw. In some versions, the IMU may record and track data over time to monitor current pitch and roll, as well as current and average height of the deck. The output from the IMU is combined with an output from an accelerometer 170, preferably having integrated the accelerometer output, and the combined signal is fed to a servo motor controller 180. The servo motor controller causes the piston or shaft of the servo to extend or retract in an effort to maintain a constant deck attitude and height as determined by the accelerometer and IMU outputs.

As shown in FIG. 6, preferably an accelerometer 170, 171 172, 173 is provided at each corner of the deck. Likewise, a separate motor controller 180, 181, 182, 183 is positioned adjacent the corresponding accelerometer, with the active suspension (or servo motor) 80, 81, 82, 83 also being positioned closely nearby. This arrangement minimizes the time delay between accelerometer values and response by the active suspension, as noted above.

Most preferably the air spring is connected to one or more air tanks 200 to provide a more consistent spring response. Although only one air tank 200 is illustrated (and for simplicity it is shown as being connected to only one air spring) it should be understood that additional air tanks may be provided, and that in the preferred version each of the air springs is connected to at least one air tank.

While the entire platform could be suspended on motor power alone, such a system would consume excessive power, or be geared down to such an extent that it would be limited in its ability to travel fast enough to track the seas. Even a fixed spring system has its limitations, as the load on the platform can vary depending on the number of passengers, and where they are standing at any one time. In this invention, the air pressure in each of the air springs is varied dynamically, in an attempt to perfectly balance the structure, so that no net motor power is required. While this system, if engineered to the extreme, could replace the motors, the compression of air (or whatever gas is used) is lossy, and the valves noisy, and therefore not as desirable. Rather, the motor current is monitored, and integrated over time so that the air is not being constantly adjusted, and when it reaches a preset level the air pressure is adjusted up or down a preset amount, in an attempt to reduce the net motor input to a minimum level.

In accordance with a preferred aspect of the invention, incorporated into certain preferred versions, the air spring is adjustable and very closely matched to the weight of the boat to be supported over a long stroke. As a general matter, any weight not being supported by the spring must be held up (or down, if the spring is too strong) by the servo motor portion of the combined air spring and servo forming the active suspension. As the boat travels through the water, particularly rough water at high speed, the pontoons are traveling up and down through maximum stroke frequently. This causes the servo motor to deliver energy to the system and recover energy from the system on the other side of the stroke, with the servo essentially acting as a spring. But servo motor systems of this type can recycle only a portion of the energy they recover back into work for the next stroke, Moreover, the energy is difficult to store and requires banks of capacitors that add to weight, inefficiency, and expense. Consequently, in a preferred system the spring is adjustable and matched closely to the weight of the boat over a long stroke.

In the preferred version as described above, the air springs are fitted with large expansion tanks such that the internal pressure changes by about 15 percent or less over the entire stroke of the system. The linkage provides a measure of mechanical advantage when the pressure in the air spring is at the lowest. During operation, the air pressure provided in the air springs is adjusted dynamically in order to keep the spring force exactly balancing gravity. In other words, when an upward force is exerted by a wave the pressure sensor detects an increase in pressure and will dynamically adjust the air spring to reduce the air pressure to the gravitational level. Conversely, when pressure is reduced as the pontoon enters a trough, the air pressure is dynamically increased by the expansion tanks and controller to raise the pressure to the gravitational level.

Notably, this form of dynamically balanced air pressure is different from a shock absorber dampening system. Indeed, while an automobile shock will seek to absorb and dampen a force the present system essentially has no dampening at all. Rather, it seeks to rapidly move the pontoons to accommodate for the forces exerted by the waves.

With reference to FIGS. 3 and 4, the preferred boat suspension system includes a heave accommodation of at least 3 feet. In other words, the height of the boat above a flat water surface is variable along a distance of at least three feet. In one example, the active suspension system 83 in the extended position (see FIG. 3) measures about 51 inches from the upper to the lower connection points of the suspension, corresponding to length H1. In this position, the lower portion of the pontoon mount 73 is at a distance of about 40 inches below the bottom of the vertical frame member pivot point 101. In the retracted position, in on example the suspension height H1 is about 35 inches (see FIG. 4), allowing for about sixteen inches of axial travel of the suspension. Because of the length of the linkage and the angular path of travel, the bottom of the pontoon mount varies between a height H2 of about 40 inches below the bottom of the vertical frame member pivot point 101 (see FIG. 3) and about 29 inches above the bottom of the vertical frame member pivot point (see FIG. 4). Thus, in the preferred version as illustrated the deck has an accommodation of about 69 inches vertically.

In order to provide a substantially level deck platform, the spring must be able to provide a fast frequency response. This is particularly the case when, for example, traveling orthogonally across the wake of another boat such that the boat will encounter peaks and troughs that are close together but quite varied in height. Most preferably, the suspension system is configured to provide a heave accommodation of at least 3 feet of vertical travel with a frequency response of less than 1 Hz.

While the preferred embodiment of the invention has been illustrated and described, as noted above, many changes can be made without departing from the spirit and scope of the invention. Accordingly, the scope of the invention is not limited by the disclosure of the preferred embodiment. Instead, the invention should be determined entirely by reference to the claims that follow.

The embodiments of the invention in which an exclusive property or privilege is claimed are defined as follows:

1. A boat, comprising:

a hull configured for flotation on water;

a deck;

a suspension system positioned between the hull and the deck and configured to suspend the deck with respect to the hull, the suspension system further configured to accommodate pitch and roll motions of the deck with respect to the hull, the suspension system also being configured to accommodate a heave motion of at least three feet of the deck with respect to the hull, the suspension system comprising a plurality of springs;

a sensor configured to determine at least one inertial reference parameter of the deck, the sensor comprising a plurality of sensors, a separate one of the plurality of sensors being positioned adjacent a corresponding one of the plurality of springs;

a controller coupled to the sensor and the suspension system, the controller being configured to control the suspension system to maintain an orientation of the deck with respect to pitch, roll, and heave through a heave accommodation of at least three feet with a frequency response of the suspension system less than or equal to 1 Hz; the controller comprising a plurality of controllers, a separate one of the plurality of controllers being configured to control a corresponding one of the plurality of springs; and the sensor further comprising an inertial measurement unit to measure an inertial reference parameter for a central portion of the deck, the inertial measurement unit being coupled to each one of the plurality of controllers for controlling the corresponding one of the plurality of springs.

2. The boat of claim 1, wherein the plurality of springs comprises a plurality of air springs, each of the air springs being coupled to an air tank, and further wherein the controller is configured to dynamically control the air pressure in the air springs.

3. The boat of claim 2, wherein the air pressure is maintained within a range of plus or minus fifteen percent throughout the full range of travel of the suspension system.

4. The boat of claim 2, wherein the suspension system comprises a plurality of servos, a separate one of the plurality of servos being coupled to one of the plurality of air springs.

5. The boat of claim 4, wherein the hull comprises a pair of pontoons and the deck is supported by a frame, each one of the pair of pontoons being coupled to the frame by a linkage having an upper linkage and a lower linkage, a separate one of the plurality of springs having a first end attached to the frame and a second end attached to the lower linkage associated with one of the pontoons.

6. A boat, comprising:

a hull configured for flotation on water;

a deck;

a suspension system positioned between the hull and the deck and configured to suspend the deck with respect to the hull, the suspension system further configured to accommodate pitch, roll, and heave motions of the deck with respect to the hull, the suspension system further having a dynamically adjustable spring;

the suspension system further comprising a plurality of springs;

a sensor configured to determine at least one inertial reference parameter of the deck, the sensor comprising a plurality of sensors, a separate one of the plurality of sensors being positioned adjacent a corresponding one of the plurality of springs;

a controller coupled to the sensor and the suspension system, the controller being configured to control the suspension system to dynamically adjust the spring to closely match the spring to the weight of the deck during motion of the deck with respect to the hull, whereby the suspension system maintains an orientation of the deck with respect to pitch, roll, and heave;

the controller comprises a plurality of controllers, a separate one of the plurality of controllers being configured to control a corresponding one of the plurality of springs; and the sensor further comprising an inertial measurement unit to measure an inertial reference parameter for a central portion of the deck, the inertial measurement unit being coupled to each one of the plurality of controllers for controlling the corresponding one of the plurality of springs.

7. The boat of claim 6, wherein each of the springs is coupled to an air tank, and further wherein the controller is configured to dynamically control the air pressure in the air springs.

8. The boat of claim 7, wherein the air pressure is maintained within a range of plus or minus fifteen percent throughout the full range of travel of the suspension system.

9. The boat of claim 6, wherein the suspension system comprises a plurality of servos, a separate one of the plurality of servos being coupled to one of the plurality of air springs.

10. The boat of claim 9, wherein the hull comprises a pair of pontoons and the deck is supported by a frame, each one of the pair of pontoons being coupled to the frame by a linkage having an upper linkage and a lower linkage, a separate one of the plurality of springs having a first end attached to the frame and a second end attached to the lower linkage associated with one of the pontoons.

* * * * *